US007584954B2

(12) United States Patent
Nagao

(10) Patent No.: US 7,584,954 B2
(45) Date of Patent: Sep. 8, 2009

(54) SHEET FEEDER DEVICE, IMAGE READING APPARATUS AND IMAGE FORMING APPARATUS

(75) Inventor: Hiroyuki Nagao, Nara (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 397 days.

(21) Appl. No.: 10/866,713

(22) Filed: Jun. 15, 2004

(65) Prior Publication Data

US 2004/0251601 A1 Dec. 16, 2004

(30) Foreign Application Priority Data

Jun. 16, 2003 (JP) ..... P2003-171137

(51) Int. Cl.
*B65H 3/52* (2006.01)

(52) U.S. Cl. ..... 271/122; 271/124; 271/125; 271/10.09; 271/10.03; 271/10.11

(58) Field of Classification Search ..... 271/122, 271/124, 125, 10.11, 10.09, 10.03, 225, 902
See application file for complete search history.

(56) References Cited

U.S. PATENT DOCUMENTS 4,558,373 A * 12/1985 Plasencia et al. ..... 358/484
4,627,607 A * 12/1986 Ishii ..... 271/122
4,801,134 A * 1/1989 Yokoyama et al. ..... 271/122
4,893,804 A * 1/1990 Sasage et al. ..... 271/3.09
5,016,866 A * 5/1991 Takahashi ..... 271/122
5,664,771 A * 9/1997 Nagatani et al. ..... 271/10.03
6,098,536 A * 8/2000 Ohkawa ..... 101/118
6,182,961 B1 * 2/2001 Wenth, Jr. ..... 271/114
6,446,958 B1 * 9/2002 Sette et al. ..... 271/225
6,557,850 B1 * 5/2003 Kallin et al. ..... 271/274
6,641,132 B2 * 11/2003 Sekine ..... 271/124

FOREIGN PATENT DOCUMENTS

JP H06-144607 A 5/1994
JP H09-216741 A 8/1997
JP 2001-278483 A 10/2001
JP 2002-060066 A 2/2002

* cited by examiner

*Primary Examiner*—Patrick H Mackey
*Assistant Examiner*—Kalyanavenkateshware Kumar
(74) *Attorney, Agent, or Firm*—Birch, Stewart, Kolasch & Birch, LLP

(57) ABSTRACT

A sheet feeder device includes a sheet accommodating section for accommodating a stack of sheets. There is a sheet pick-up section which can operate to feed each of the sheets toward a sheet feed path when abutting against the stack. A sheet separating section is also provided and it has a feed roller and a reverse roller which are located downstream of the sheet pick-up section and abut against each other. The reverse roller is supported on a rotation support shaft in a manner to allow the reverse roller to be fitted around and removed from the rotation support. The rotation support has opposite ends supported by a device body.

18 Claims, 9 Drawing Sheets

SHEET FEEDER DEVICE, IMAGE READING APPARATUS AND IMAGE FORMING APPARATUS

CROSS REFERENCE

This Non provisional application claims priority under 35 U.S.C. §119(a) on patent application Ser. No. 2003-171137 filed in Japan on Jun. 16, 2003, the entire contents of which are hereby incorporated by reference.

BACKGROUND OF THE INVENTION

The present invention relates to a sheet feeder device for feeding document sheets, an image reading apparatus and an image forming apparatus.

Recently, efficient image reading or image forming has become possible by setting, on an image forming apparatus for example, a document reading apparatus configured to automatically feed documents in the form of sheets for successive reading. Further, with increasing speed in reading an image of a document, converting the image into electronic data and forming an image based on the electronic data by virtue of the development of digital technology, it has become possible to process a larger number of document sheets at high speed. Such a recent document reading apparatus allows a very large number of document sheets, for example about 100 to 200 sheets, to be set thereon at a time. Further, the improvement of the document feeder section of the document reading apparatus has made it possible to feed various types of document sheets.

The above-described image reading apparatus, which is configured to feed a number of sheets such as document sheets set thereon and read images formed on the sheets, picks up the document sheets stacked on a document tray one by one for image reading. To feed only a single sheet of the document stack to a reading section, use is made of a separating mechanism comprising a combination of a feed roller and a reverse roller. Specifically, when plural sheets are picked up at a time, the lower sheet(s) contacting the reverse roller is returned to the document tray so that only the sheet contacting the feed roller can be fed to a feed path leading to the reading section.

In such an arrangement, the reverse roller of the separating mechanism is connected, via a torque limiter, to a driving section for rotating the reverse roller in a direction opposite to the rotating direction of the feed roller. At a load torque working when only a single document sheet is pinched by the separating mechanism, the reverse roller slips relative to the driving section and hence rotates in the direction of movement of the document sheet, thereby allowing the sheet to pass through the separating mechanism. On the other hand, when two or more sheets are to be pinched, the load torque increases and the torque limiter prevents the reverse roller from slipping, so that the reverse roller rotates in the direction opposite to the sheet feed direction. As a result, only a single sheet is allowed to pass through the separating mechanism reliably.

Generally, the feed roller confronting the reverse roller and the pick-up roller for paying out sheets are each supported on the apparatus body in a cantilevered fashion so that they can be replaced easily at the time of maintenance or in the case where the function for preventing sheets from being fed as superposed on each other is deteriorated due to friction or the like or any other trouble occurs. (See paragraphs 0023-0025 and FIGS. 1 and 2 of Japanese Patent Laid-Open Publication No. 2002-60066, and paragraphs 0008-0013 and FIG. 4 of Japanese Patent Laid-Open Publication No. HEI 6-144607, for example.)

However, for the reasons that the reverse roller contacting the feed roller is generally disposed under the feed roller and the feed roller is supported in a cantilevered fashion, when the reverse roller confronting the feed roller is also supported in a cantilevered fashion as in the aforementioned Japanese Patent Laid-Open Publications No. 2002-60066 and No. HEI 6-144607, the two rollers cannot be held in contact with each other stably, which likely results in lowered sheet separating performance.

When the sheet separating performance is lowered, problems such as feeding of sheets as superposed on each other or a jam are likely to occur. For this reason, it is a general practice to support the reverse roller at both ends thereof. However, such a both ends support structure makes attachment or detachment of the roller difficult, thus rendering the maintenance troublesome.

SUMMARY OF THE INVENTION

A feature of the present invention is to provide a sheet feeder device including a separating section having a reverse roller which is supported at both ends thereof and is easily attachable/detachable for replacement. Another feature of the invention is to provide an image reading apparatus and an image forming apparatus each provided with such a sheet feeder device.

According to an embodiment of the present invention, a sheet feeder device comprises: a sheet accommodating section for accommodating a stack of sheets; a sheet pick-up section operative to feed each of the sheets toward a sheet feed path when abutting against the stack; and a sheet separating section having a feed roller and a reverse roller which are located downstream of the sheet pick-up section and biased to abut against each other, wherein: the reverse roller is supported on a rotation support shaft in a manner to allow the reverse roller to be fitted around and removed from the rotation support shaft in an axial direction of the rotation support shaft; the rotation support shaft has opposite ends rotatably supported by a device body via a first support and a second support; and the first support is movable in a direction to move the reverse roller away from the feed roller, while the rotation support shaft is detachable from the first support.

In this construction, the reverse roller is supported by the device body at both ends thereof via the first support and the second support and hence can be stably held abutting against the feed roller of the sheet separating section even when the feed roller is supported in a cantilevered fashion. Therefore, the sheet separating function works stably to ensure a satisfactory sheet feeding condition.

At the occasion of replacement or checking of the reverse roller or like occasions, the first support supporting the reverse roller is allowed to pivot to separate the reverse roller away from the feed roller. By so doing, the rotation support shaft can be detached from the first support with easy operation and without being hindered by the feed roller. Thereafter, the reverse roller can be easily detached from the rotation support shaft. Thus, the maintenance of the sheet feeder device can be performed easily.

In another embodiment of the present invention, the rotation support shaft is supported via a universal joint for swinging movement. This arrangement allows the rotation support shaft to swing when the first support pivots in such a direction as to move the reverse roller away from the feed roller. Therefore, the separation of the reverse roller from the feed roller can be achieved smoothly.

In still another embodiment of the present invention, the first support is pivotable relative to the device body, the first support comprising: a first support member pivotally supported by the device body; and a second support member formed to be removably fitted on the first support member and supporting the rotation support shaft, the rotation support shaft being detachable from the second support member when the second support member is detached from the first support member.

In this arrangement, the first support member and the second support member of the first support are separable from each other and, hence, the second support member can be detached from the rotation support shaft by separating the second support member from the first support member while keeping the first support member as it is. Therefore, the reverse roller can be pulled out from the rotation support shaft easily, whereby the replacement of the reverse roller can be achieved easily.

In still another embodiment of the present invention, the sheet feeder device further comprises a resilient member bridging the first support member and the device body for biasing the reverse roller into abutment against the feed roller at a predetermined pressure.

In this arrangement, the resilient force of the resilient member biases the reverse roller to abut against the feed roller at a predetermined pressure. Thus, a stabilized abutting pressure can be obtained and, hence, the sheet separating function can be stabilized.

In still another embodiment of the present invention, the first support member includes a release lever portion for separating the reverse roller away from the feed roller, the release lever portion and an openable external cover provided on the device body being cooperatively connected to each other via a coupling lever.

In this arrangement, when the external cover is opened, the release lever moves following the movement of the cover via the coupling lever, thereby separating the reverse roller away from the feed roller. Therefore, any additional operation for moving the reverse roller away from the feed roller is unnecessary, so that the replacement of the reverse roller can be achieved with high operability. Therefore, the sheet separating function can easily be prevented from lowering.

These and other objects, features and attendant advantages of the present invention will become apparent from the following detailed description of the preferred embodiments to be read with reference to the accompanying drawings.

DETAILED DESCRIPTION OF THE INVENTION

Hereinafter, a sheet feeder device and an image reading apparatus provided with the sheet feeder device according to an embodiment of the present invention will be described in detail with reference to the accompanying drawings.

Figure 1:
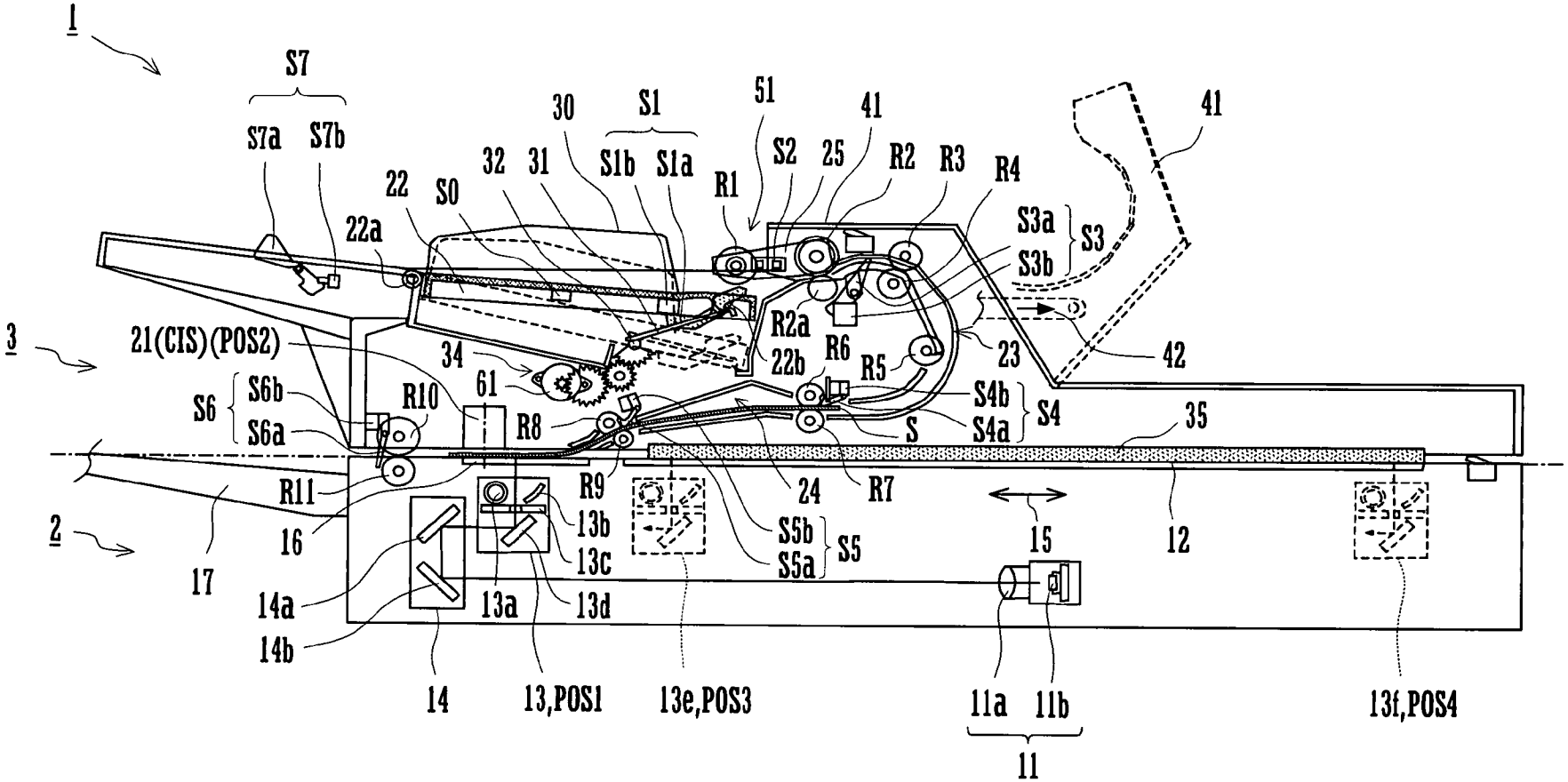
FIG. 1 is a view showing the construction of a sheet feeder device embodying the present invention.

FIG. 1 is a vertical sectional view showing the overall construction of an image reading apparatus 1 according to an embodiment of the present invention. The image reading apparatus 1, which generally comprises an optical system 2 and an ADF (Automatic Document Feeder) 3 disposed above the optical system 2, is for use as a scanner of a copying machine or a facsimile apparatus and capable of reading both sides of a document (a sheet in the present invention).

The optical system 2 includes a CCD (Charge Coupled Device) reading unit 11 as a first reading section. The optical system 2 performs image reading by using a light source unit 13 and a mirror unit 14 to form an image of the document, which is placed flat on a platen 12, on the CCD reading unit 11 fixed at a predetermined position. The CCD reading unit 11 includes an imaging lens 11*a*, a CCD image sensor 11*b*, and the like.

The light source unit 13 comprises a light source 13*a*, a mirror 13*b* for condensing image reading light from the light source 13*a* onto a predetermined image reading position on the platen 12, a slit 13*c* allowing only reflected light from the document to pass therethrough, and a mirror 13*d* for changing the direction of the light path of the light having passed through the slit 13*c* by 90°. The mirror unit 14 comprises a pair of mirrors 14*a* and 14*b* for changing the direction of the light path of light from the mirror unit 13 by 180°. When the light source unit 13 moves at a velocity V, the mirror unit 14 moves at a velocity of V/2. The light source unit 13 moves in the direction of arrow 15 (secondary scanning direction) to such positions as indicated by reference characters 13*e* and 13*f* to read the document image.

Though not illustrated, the CCD reading unit 11 may be structured to move a unit of an optical reading system for reduced-size reading or actual-size reading comprising at least CCD image sensor 11*b*, imaging lens 11*a* and light source 13*a* for scanning at a velocity V.

The optical system 2 further includes another platen 16 spaced apart from the glass platen 12 in the secondary scanning direction. The light source unit 13, when moved to and held at a position below the platen 16, can read the image on a first surface (hereinafter will be defined as an obverse surface) of a document sheet being transported over the platen 16. Adjacent the outlet for the document sheet thus transported is provided an ejected sheet tray 17.

The ADF 3 includes a CIS (Contact Image Sensor) 21 as a second reading section and feeds the document sheets stacked on a document tray (sheet accommodating section of the present invention) 22 one by one. The CIS reads the image on a second surface (hereinafter will be defined as a reverse surface) of the document sheet being transported.

For this purpose, the ADF 3 further comprises different types of rollers R1 to R10, detectors S1 to S7, curved feed path 23, and a registration/skew-correction region 24. The CIS 21 is a contact image sensor comprising an array of image sensors, an array of light guide portions (for example a lens array of selfoc lenses), a light source (an LED array or a fluorescent lamp), and the like.

When optical document detector S1 comprising an actuator S1*a* and a sensor body S1*b* detects that a stack of document sheets is set on the document tray 22, lifting of the document tray 22 is started at a predetermined timing. When a pick-up roller detector S2 detects that the uppermost sheet of the stack presses up the pick-up roller R1 which is supported by an arm 25 for up-and-down movement, the lifting of the document tray 22 is stopped temporarily. Thus, a standby state is provided.

In the case where a signal to start the image reading is not inputted for a predetermined period after the document tray 22 carrying the document sheets has been held in the standby state following lifting, the document tray 22 is preferably lowered to a predetermined level to stand by at that position for preventing the pick-up roller (sheet pick-up section of the present invention) R1 from being deformed, although the standby state of the document tray 22 at the lifted position may be maintained.

When a signal to start the feeding of the document sheets is inputted, the pick-up roller R1 is rotated so that the sheets are picked up one by one from the uppermost one of the document stack. On the downstream side of the pick-up roller R1 are disposed feed roller (separating roller) R2 and reverse roller R2*a* which serve as a sheet separating section. The pick-up roller R1 is supported by the arm 25, which is pivotally supported by the rotating shaft of the feed roller R2.

The pick-up roller R1 becomes abutting against the document by its own weight or by a biasing force. A stopper, which will be described later, prevents the pick-up roller R1 from lowering more than necessary. The arm 25 is formed with a projection, while the pick-up roller detector S2, which comprises a photosensor and the like, detects the height of the pick-up roller R1 based on the pivoting angle of the arm 25.

In this embodiment, the projection is provided on the arm 25 as noted above for allowing the pick-up roller detector S2 to detect the position of the pick-up roller S2. However, the pick-up roller detector S2 may be located as spaced apart from the arm 25. In such a case, the height of the arm 25 may be detected by utilizing a coupler such as a link mechanism. It is to be noted that the document tray 22, pick-up roller R1, feed roller R2 and reverse roller R2*a* described above constitute a sheet feeder device 51 according to the present invention.

The reverse roller R2*a*, which is provided with a torque limiter, is arranged to confront the feed roller R2 so that the document sheets are reliably fed separately one by one without feeding document sheets as superposed on each other. Therefore, even when plural document sheets are collectively taken in by the pick-up roller R1, only the uppermost sheet intimately contacting the pick-up roller R1 is fed toward the curved feed path 23 by the combination of the feed roller R2 and the reverse roller R2*a*.

Sheet feed detector S3, which comprises an actuator S3*a* and a sensor body S3*b*, detects whether or not the uppermost document sheet is separately fed properly. Thereafter, each document sheet is guided to the curved feed path 23 on the downstream side at a predetermined timing.

Each document sheet is then transported along the curved feed path 23 by means of feed rollers R3 to R7. Sheet feed detector S4, which comprises an actuator S4*a* and a sensor body S4*b*, for detecting the passage of each document sheet through the curved feed path 23, detects whether or not each document sheet is guided smoothly. The feed path 23 has such a curvature as to allow any kind of document sheets, even the thickest or the stiffest document sheet among the readable documents, to be transported stably.

An openable external cover 41 provided on the apparatus body so as to cover the curved feed path 23 and the combination of feed roller R2 and reverse roller R2*a*. The external cover 41 in an open state is depicted with broken lines. There is also provided a coupling lever 42 for causing the support mechanism of the reverse roller R2*a* to move cooperatively with the open/close movement of the external cover 41. Though not shown, the coupling lever 42 may be configured not to move along with the external cover 41 but to be operated from the outside of the apparatus body.

Each document sheet outgoing from the curved feed path 23 is transported to the registration/skew-correction region 24. When the leading edge of each document sheet is detected by sheet feed detector S5 disposed at a location just before reaching a pair of register rollers R8 and R9 located adjacent the outlet of the registration/skew-correction region 24, the rotation of the register rollers R8 and R9 is interrupted. In this state, the document sheet is pressed against the rollers R8 and R9 by the feeding force from the upstream side for a predetermined period, whereby registration and skew-correction of the sheet are achieved. The sheet feed detector S5 comprises an actuator S5*a* and a sensor body S5*b*.

For the registration and skew-correction described above to be achieved properly, the registration/skew-correction region 24, which extends between the most downstream feed rollers R6,R7 of the curved feed path 23 and the register rollers R8,R9, is so designed that each document sheet S can be kept flat between the pair of rollers R6,R7 and the pair of rollers R8,R9 without the possibility of deformation caused by the guide surface of the feed path.

It is only necessary for the distance between the pair of rollers R6,R7 and the pair of rollers R8,R9 to be set not smaller than the length, extending in the feeding direction, of a document sheet of the smallest size among document sheets which can be handled by the sheet feeder device. Thus, the smaller the trailing edge portion of the document sheet remaining in the curved feed path 23 is, the more smoothly the registration and skew-correction can be performed.

After the registration and skew-correction is performed, the feeding of the document sheet is restarted at a predetermined timing and the document sheet is guided to a first read position (traveling document read position) Pos1 for exposure and scanning of the obverse surface of the document sheet. Subsequently, the document sheet passes through a second read position Pos2 for exposure and scanning of the reverse surface of the document sheet. The light source unit 13 is disposed to face the first read position Pos1, whereas the CIS 21 disposed to face the second read position Pos2.

The document sheet of which image on the obverse surface or on both of the obverse and the reverse surfaces has been read is ejected by ejecting rollers R10 and R11 onto the ejected sheet tray 17 supported on a lateral side of the image reading apparatus 1 at a position lower than the document ejection point. (The ejecting roller R11 is located on the optical system 2 side.) Sheet ejection detector S6 comprising an actuator S6*a* and a sensor body S6*b* detects the ejection of each document sheet.

The operation described above is repeated until the document tray 22 on which document sheets have been set is emptied. All the document sheets having been finished with image reading are successively ejected onto the ejected sheet tray 17.

As the document sheets are fed successively, the height of the document stack on the document tray 22 decreases. Therefore, monitoring is conducted so that, when the height decreases to a certain level, the tray 22 is lifted by an amount corresponding to the amount of a drop of the position of the pick-up roller R1, whereby proper positional relationship is maintained between the uppermost sheet of the document stack and the pick-up roller R1. For this purpose, the document tray 22 is made pivotable about a supporting point 22*a*, while a rib 22*b* provided at an end opposite from the supporting point 22*a* is configured to be pressed up by a lifting plate 31 for up and down movement.

An end of the lifting plate 31 opposite from the end provided with the rib 22*b* is fixed to a plate support shaft 32. The plate support shaft 32 is driven for rotation by a lift motor 61 via a lift mechanism 34 comprising a train of transmission members (gears).

A controller, which will be described later, controls the lift motor 61 of the lift mechanism 34 based on an actuating signal from the pick-up roller detector S2 so that the position of the document tray 22 in the standby state is maintained. The position of the tray 22 is selectable as desired depending on the number of document sheets which is likely to be set frequently, and the selected position can be set in advance by a serviceman or a user from a control section, which will be described later.

Further, the document tray 22 is movable up and down within the height range necessarily defined between the inlet side and the outlet side of the curved feed path 23 provided for assuring the reliable document feed, as described above. Since the tray 22 is movable up and down, a large number of document sheets can be stacked on the tray 22. Thus, the document tray 22 is capable of raising the level of the uppermost sheet of the document stack thereon to a position appropriate for feeding to the inlet of the curved feed path 23, whereby the document sheets can be successively fed one by one.

The document tray 22 is provided with a document restricting plate 30 for aligning side edges of the document sheets. The position of the document restricting plate 30 is detected by document size detector S0 and the position thus detected is utilized for sheet selection in image formation, for example.

In reading a document sheet placed on the platen 12, the light source unit 13 moves from the position Pos3 toward the position Pos4 in FIG. 1 by a predetermined distance depending on the size of the document sheet detected by the document size detector S9 which is not shown in FIG. 1. On the other hand, reading of a document sheet under feeding is performed with the light source unit kept stationary at the position Pos1. Based on the detection result obtained by the position detector of the light source unit 13, any of the position Pos3, the position Pos4, and an intermediate position between Pos3 and Pos1 can be determined as the home position. The light source unit 13 is kept stationary at the home position in the standby state where it is not used.

To enable the setting of a document on the platen 12 for reading, the ADF 3 can pivot upward about a hinge (not shown) provided on the rear side of the image reading apparatus (deeper side in the figure) between the ADF 3 and the optical system 2. With this arrangement, the upper surface of the platen 12 of the image reading apparatus 1 can be exposed so that a document that cannot be fed, such as a book, can be set on the platen 12. A document mat 35 is provided on the ADF 3 side so as to face the platen 2.

The image reading apparatus 1 thus constructed can perform image reading in three modes, i.e., a stationary document reading mode, a traveling document reading mode and a both-sides reading mode. The stationary document reading mode is a mode for reading such a document as a book placed on the platen 12 by using the CCD reading unit 11 while moving the light source unit 13 and the mirror unit 14.

The traveling document reading mode and the both-sides reading mode are modes for reading document sheets set on the document tray 22 while automatically feeding the sheets one by one with the ADF 3. The image reading in the traveling document reading mode is performed using the CCD reading unit 11, whereas the image reading in the both-sides reading mode performed using both of the CCD reading unit 11 and the CIS 21. The maximum number of document sheets which can be set on the document tray 22 is 200, for example.

Figure 2:
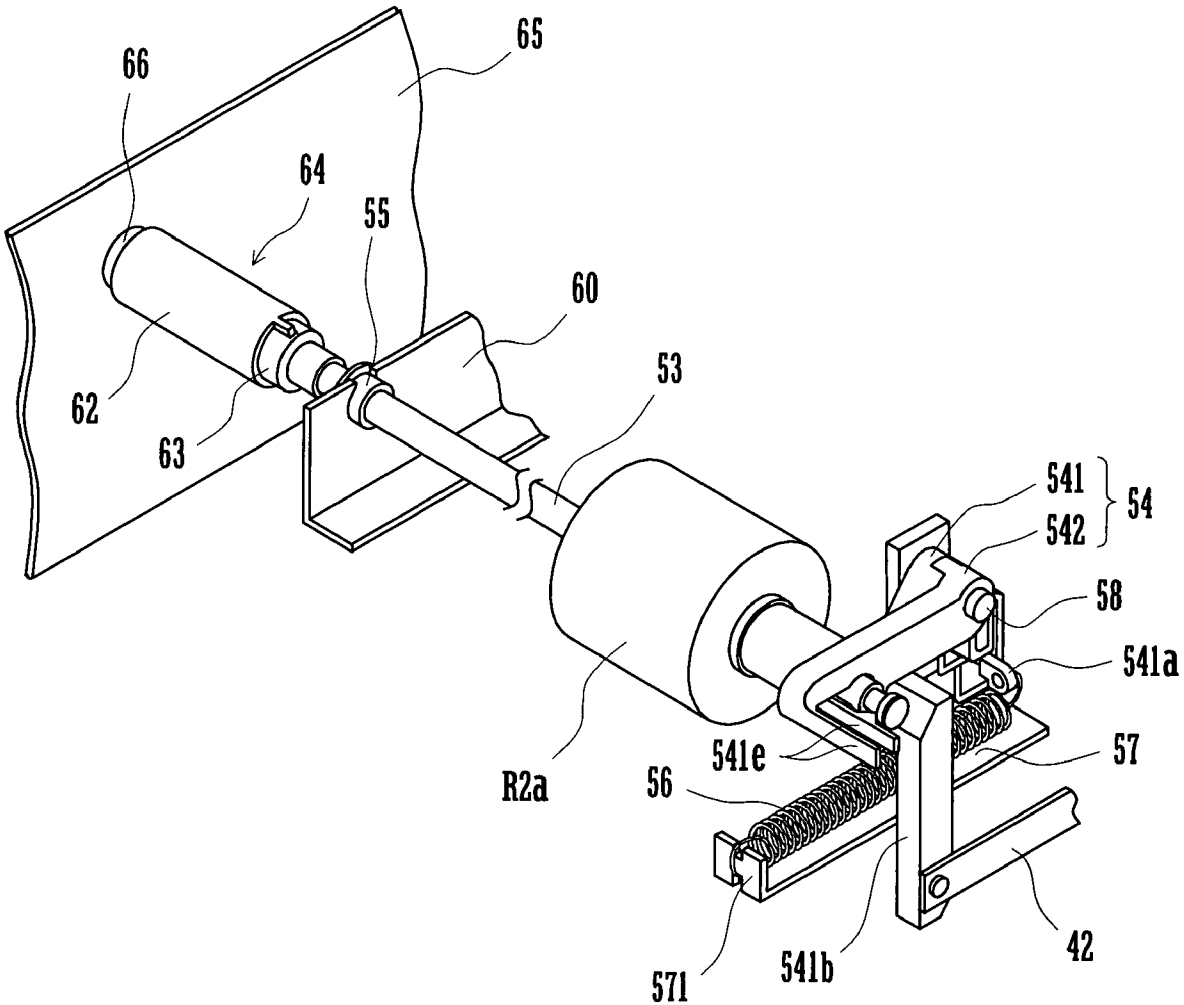
FIG. 2 is a perspective view showing a portion of the sheet feeder device.
Figure 3:
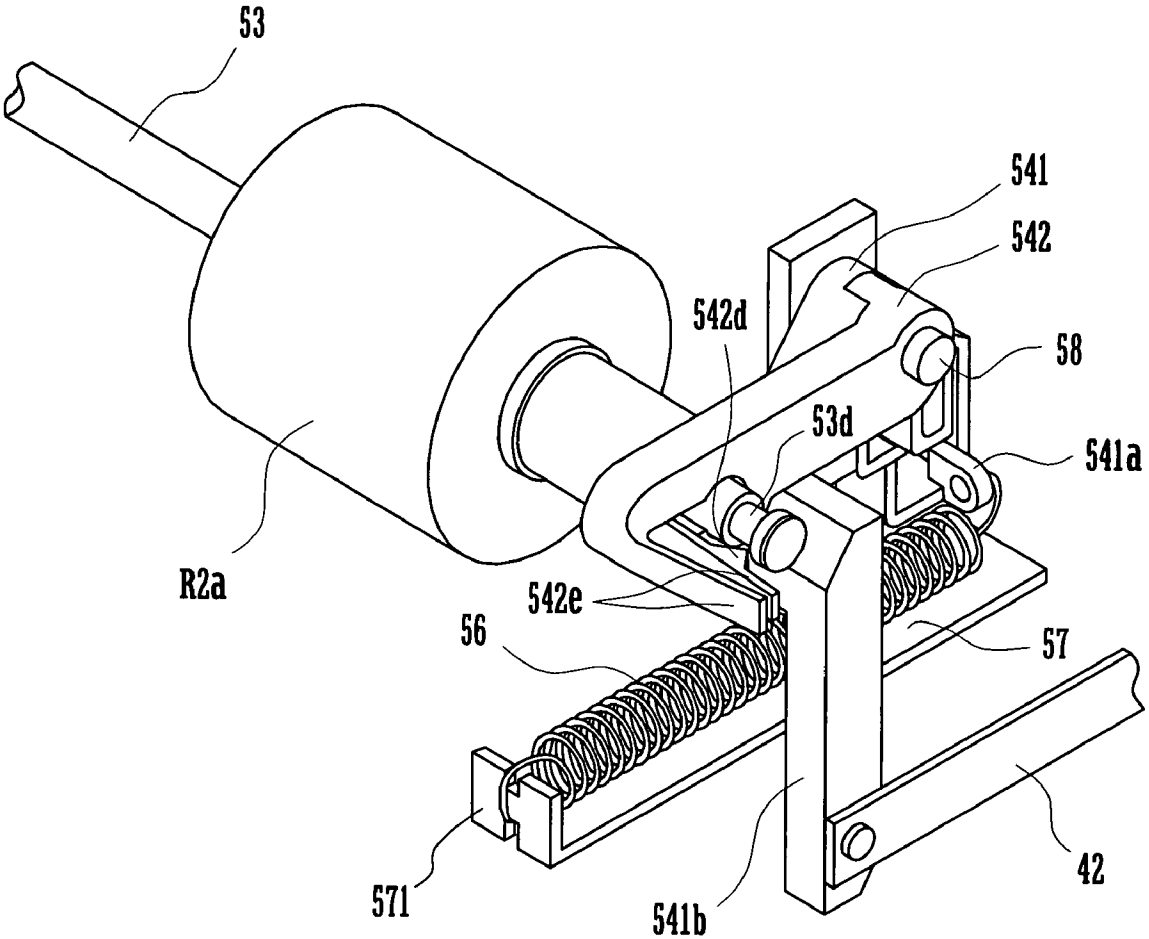
FIG. 3 is an enlarged perspective view showing a portion of the sheet feeder device.
Figure 4:
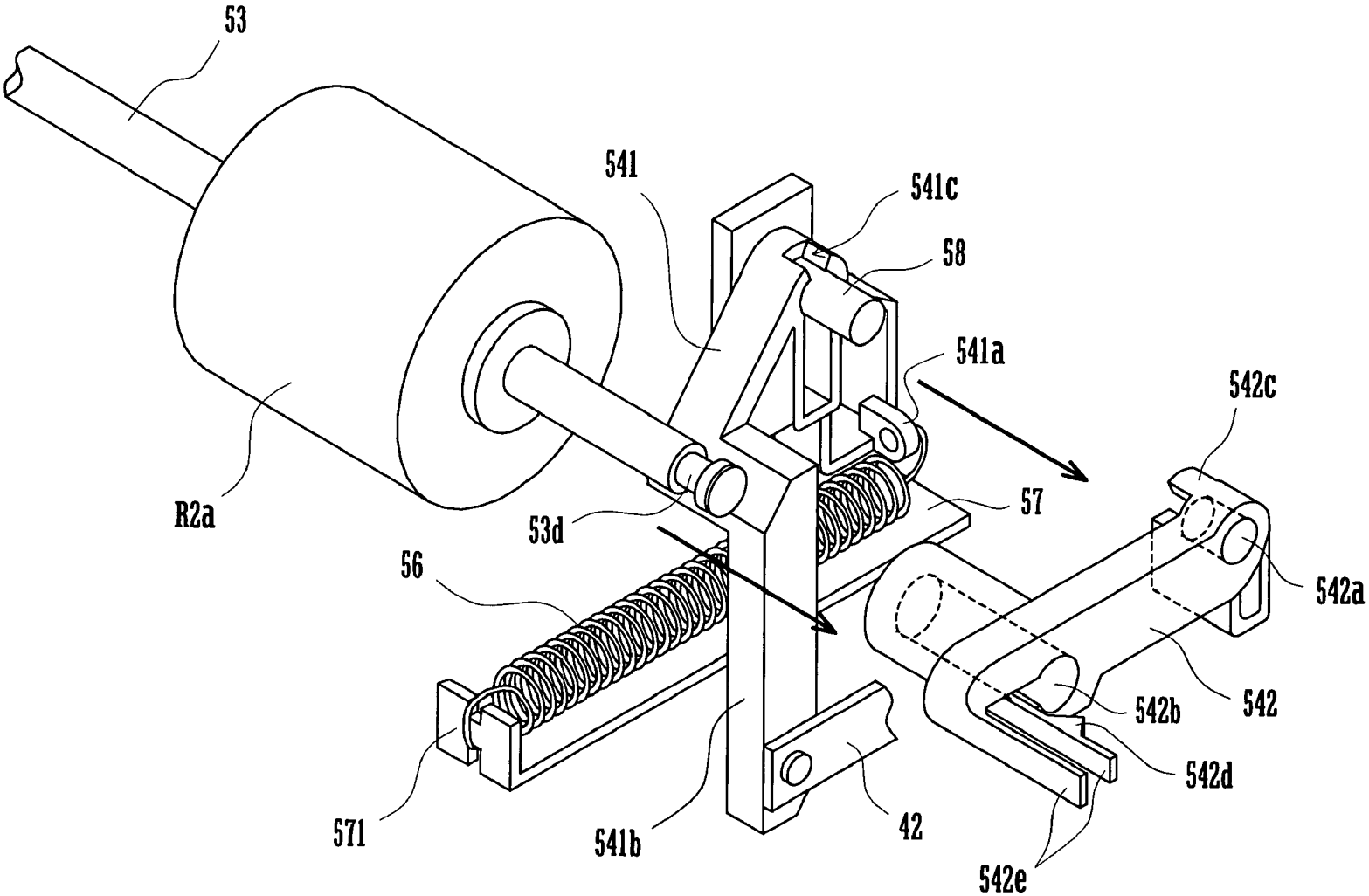
FIG. 4 is a perspective view showing a portion of the sheet feeder device in a state where the second support member is separated from the first support member.

FIGS. 2 to 4 each show the structure of a portion of the sheet feeder device 51 in detail. As described with reference to FIG. 1, the sheet feeder device 51 is made up of the document tray 22 as the sheet accommodating section, the pick-up roller R1 as the sheet pick-up section for feeding sheets, and the combination of feed roller R2 and reverse roller R2*a* located downstream of the pick-up roller R1 and serving as a sheet separating section. The reverse roller R2*a* is removably fitted on and supported by rotation support shaft 53 (See FIG. 4).

As shown in FIG. 2, the rotation support shaft 53 has opposite ends supported by the device body via first and second supports 54 and 55. The first support (the support 54 in this embodiment) is pivotally supported by the device body. With this arrangement, the reverse roller R2*a* can be separated away from the feed roller R2 and easily detached from the rotation support shaft 53 with the feed roller R2 kept as it is.

As shown in FIGS. 3 and 4, the first support 54 on the near side comprises a first support member 541 pivotally supported by the device body, and a second support member 542 removably fitted to the first support member 541 and holding the rotation support shaft 53. By detaching the second support member 542 from the first support member 541, the near side of the rotation support shaft 53 is released. In this state, the reverse roller R2*a* can be pulled out from the rotation support shaft 53 for detachment.

As shown in FIG. 2, the second support 55 on the deeper side comprises a bearing attached to a support plate 60 standing on the device body. The rotation support shaft 53 projecting rearward through the second support 55 is supported by a bearing 66 attached to a frame member 65 of the device body via a universal joint 64 (the universal joint defined in the present invention) comprising two joints 62 and 63. The rotation support shaft 53 is connected to and driven by the driving system provided outside of the frame member 65. Therefore, the near side of the rotation support shaft 53 is allowed to swing in universal direction (in all directions), which facilitates the detachment of the reverse roller R2*a*, as described above.

More specifically, an end of the first support member 541 is swingably (pivotally) supported on a support shaft 58 projecting above a generally L-shaped support plate 57 fixedly standing on the device body, and an engagement portion 541*a* is provided to project below the end. A resilient member 56 is provided having an end engaging the engagement portion 541*a* and the other end engaging a lower bent end 571 of the support plate 57. The (constantly biasing) resilient force of the resilient member 56 biases the reverse roller R2*a* to press against the feed roller R2 (See FIG. 5).

Figure 6:
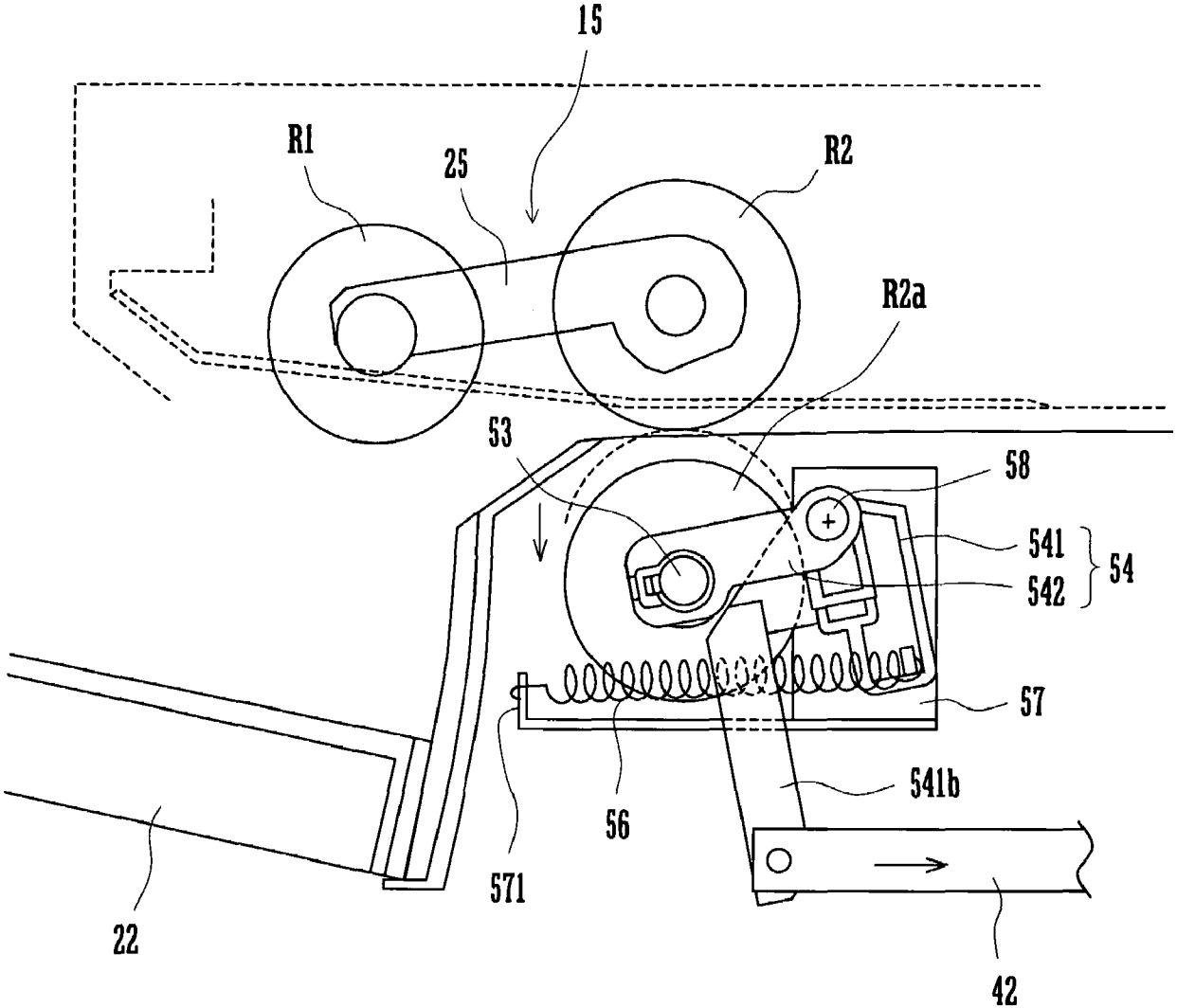
FIG. 6 is a view illustrating a portion of the sheet feeder device in a state where the reverse roller is separated from the feed roller.

As shown in FIG. 4 for example, the first support member 541 is bent at a right angle at the generally central portion to provide a release lever portion 541*b* extending toward the other end. The release lever portion 541*b* has an end to which an end of a coupling lever 42 is attached pivotally. The coupling lever 42 has the other end pivotally attached to the openable external cover 41 (See FIG. 1). Therefore, as shown in FIG. 6 for example, as the external cover 41 moves to open, the coupling lever 42 moves in the direction indicated by the arrow in FIG. 6 cooperatively with the movement of the cover, thereby causing the first support member 541 to pivot counterclockwise against the resilient force of the resilient member 56. As a result, the reverse roller R2*a* moves away from the feed roller R2. Although the resilient member 56 in this embodiment comprises a tension coil spring made of stainless steel wire for springs or steel wire for springs, use may be made of a leaf spring made of stainless steel sheet for springs or phosphor bronze sheet.

As shown in FIG. 4, the second support member 542, which is removably fitted to the first support member 541, has an end formed with a shaft hole 542*a* fitted around the support shaft 58 for rotation and a projection 542*c* fitted in a recess 541*c* formed at an end of the first support member 541. The other end of the second support member 542 is formed with a shaft hole 542*b* holding the rotation support shaft 53 for rotation and a come-off preventive projection 542*d* in sliding engagement with a circumferential groove 53*d* formed at an end of the rotation support shaft 53. This end is further formed with a tab 542*e* for separating the second support member 542 from the first support member 541.

In this arrangement, when the second support member 542 is in the state fitted to the first support member 541, the two members are fixedly joined together by the fit of the projection 542*c* of the second support member 542 in the recess 541*c* of the first support member 541. Further, the second support member 542 supports the rotation support shaft 53 for rotation while preventing the shaft 53 from coming off, and the reverse roller R2*a* is biased to press against the feed roller R2 by the resilient force of the resilient member 56 (See FIG. 5).

Figure 5:
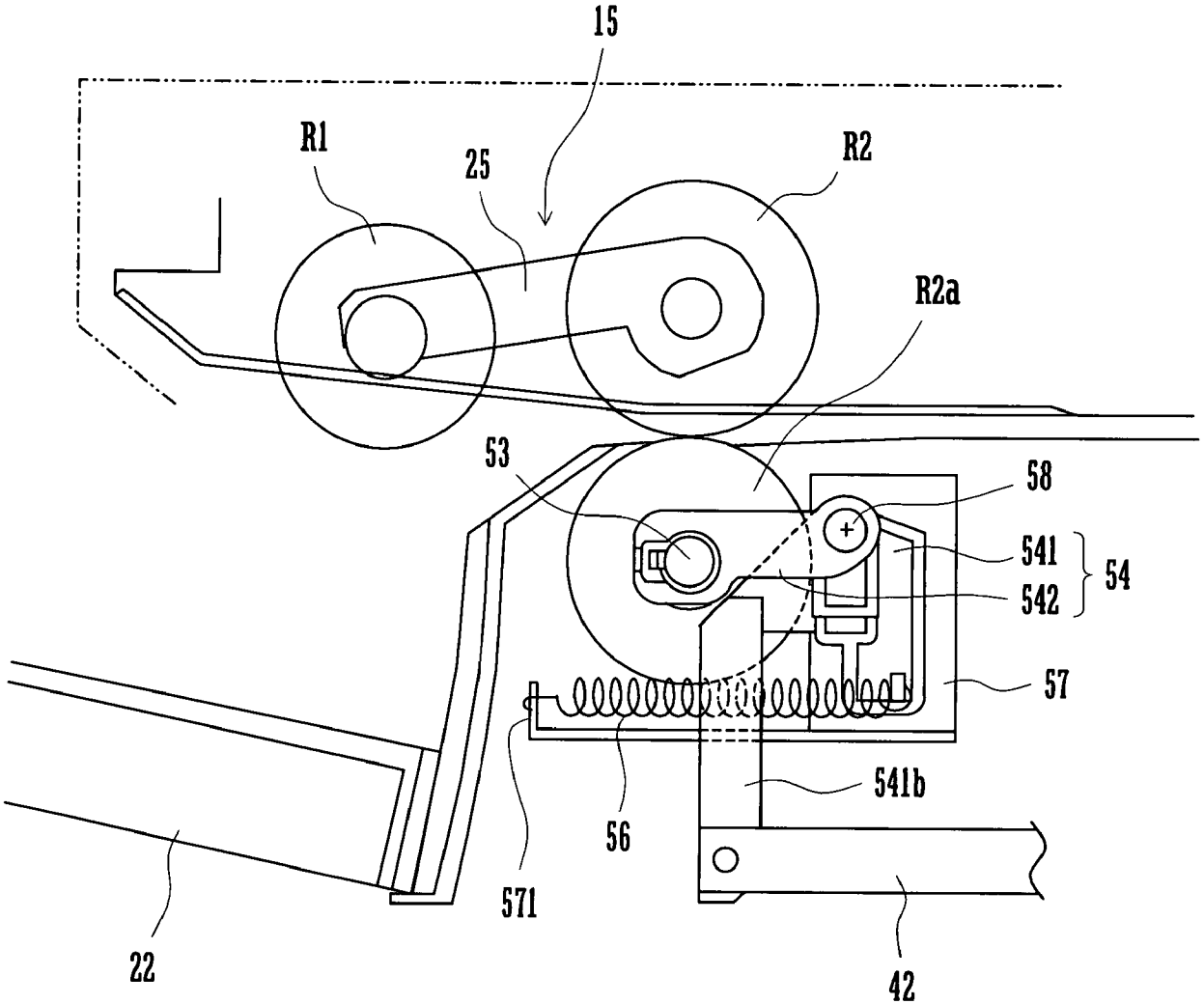
FIG. 5 is a view illustrating the structure of a portion of the sheet feeder device.
Figure 7:
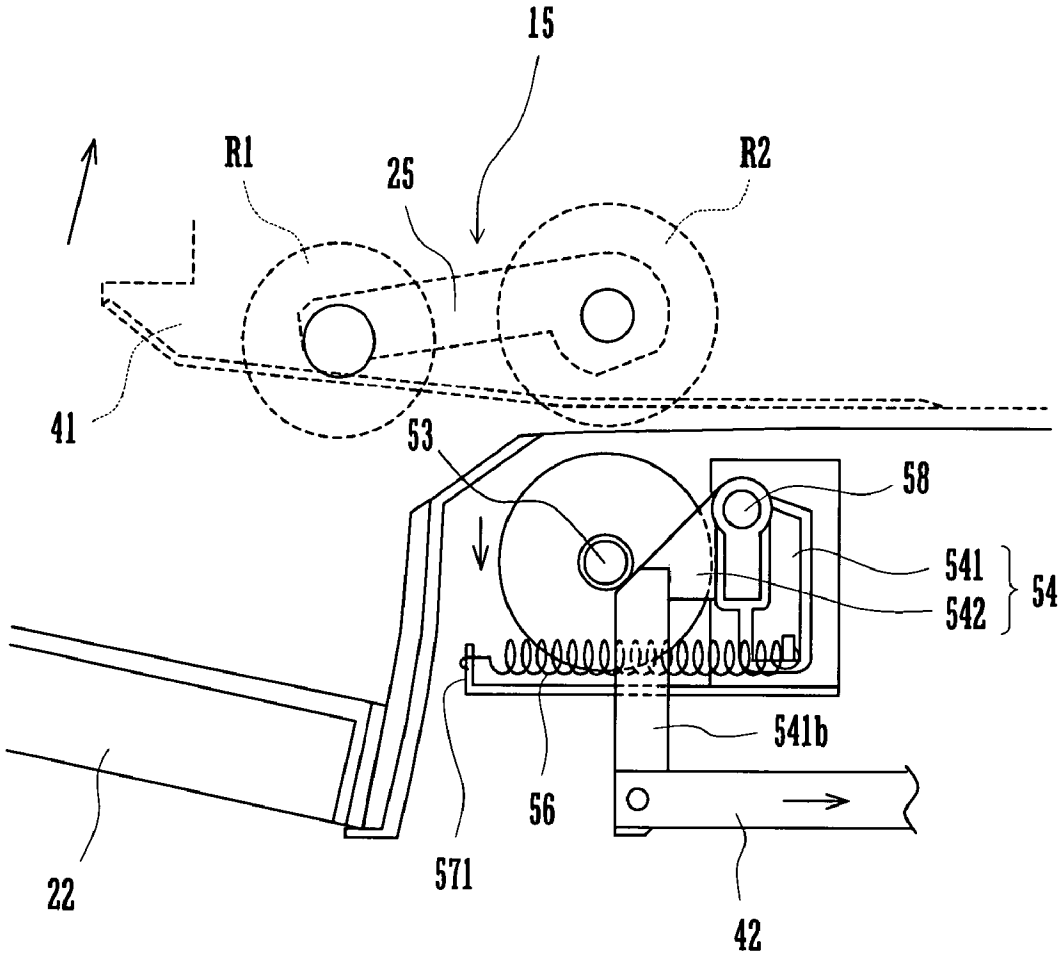
FIG. 7 is a view illustrating the disassembling of the sheet feeder device for maintenance.

Next, the procedure for replacement of the reverse roller R2*a* will be described (See FIGS. 5 to 7). First, as indicated by broken lines in FIG. 1, the external cover 41 is opened. At this time, the coupling lever 42 coupling the release lever portion 541*b* of the first support member 541 to the external cover 41 cooperates with the external cover 41, so that the state shown in FIG. 5 changes into the state shown in FIG. 6 where the separating section is released (i.e., the reverse roller R2*a* is separated away from the feed roller R2 in the separating section).

In this state, the reverse roller R2*a* does not serve as a bar to the detachment of the feed roller R2. After removal of a coupling support member, which supports the arm 25 supporting both of the pick-up roller R1 and the feed roller R2 for rotation to provide an appropriate positional relationship therebetween, the pick-up roller R1 and the feed roller R2 are detached from respective rotation shafts (See FIG. 7).

Subsequently, an inner cover (not shown) covering the supports for the reverse roller R2*a* is removed and the tab 542*e* (see FIG. 3) of the second support member 542 of the reverse roller R2*a* is gripped to separate the second support member 542 from the first support member 541. Thus, the end of the rotation support shaft 53 on the near side is made free. In this state, the reverse roller R2*a* is pulled out from the rotation support shaft 53 and then replaced with a new reverse roller R2*a*. Thereafter, the original state is resumed by reversing the above-described procedure. At that time, the pick-up roller R1 or the feed roller R2 may be replaced with a new one as required.

Figure 8:
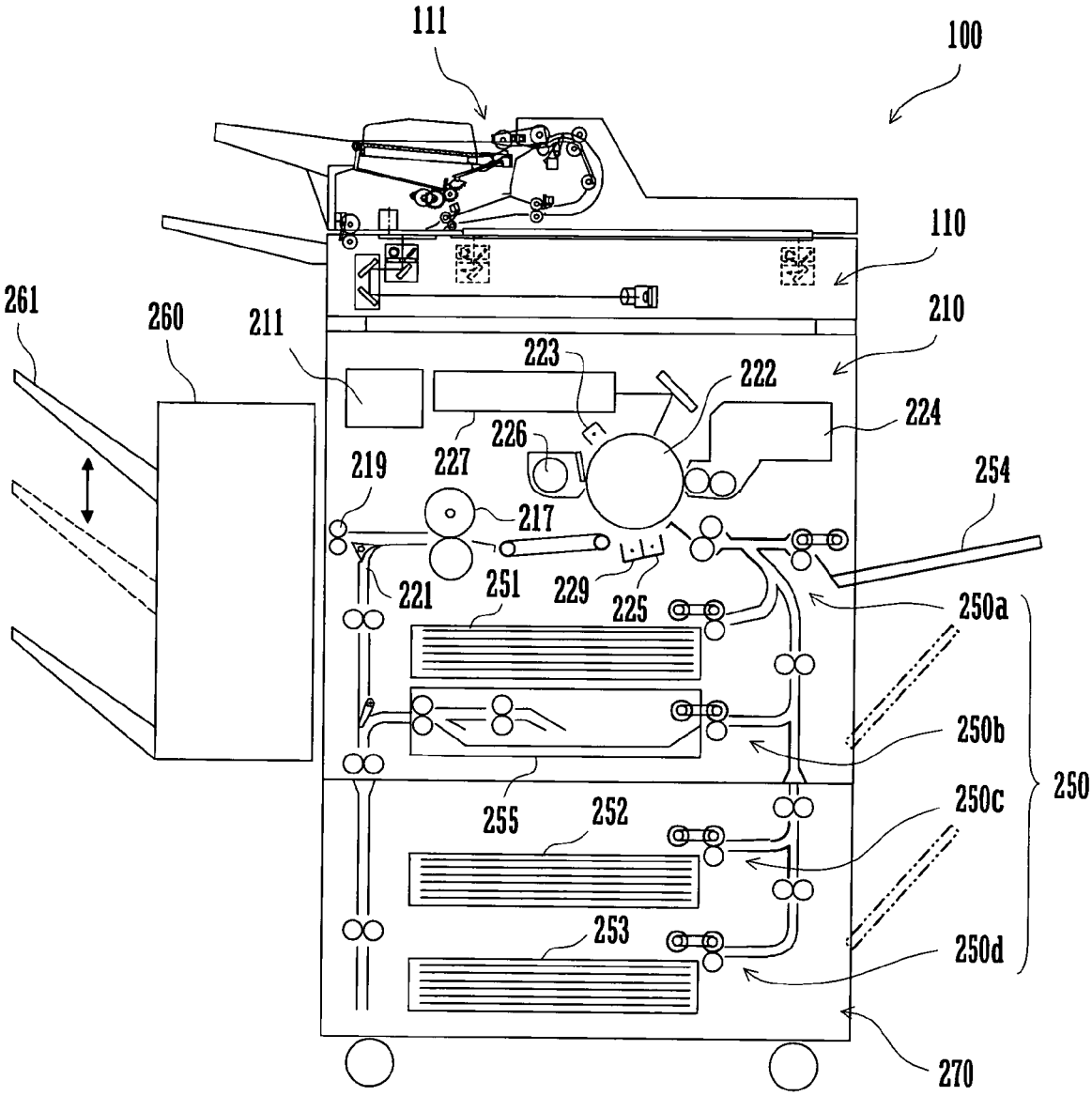
FIG. 8 is a view illustrating the construction of an image forming apparatus provided with the sheet feeder device.
Figure 9:
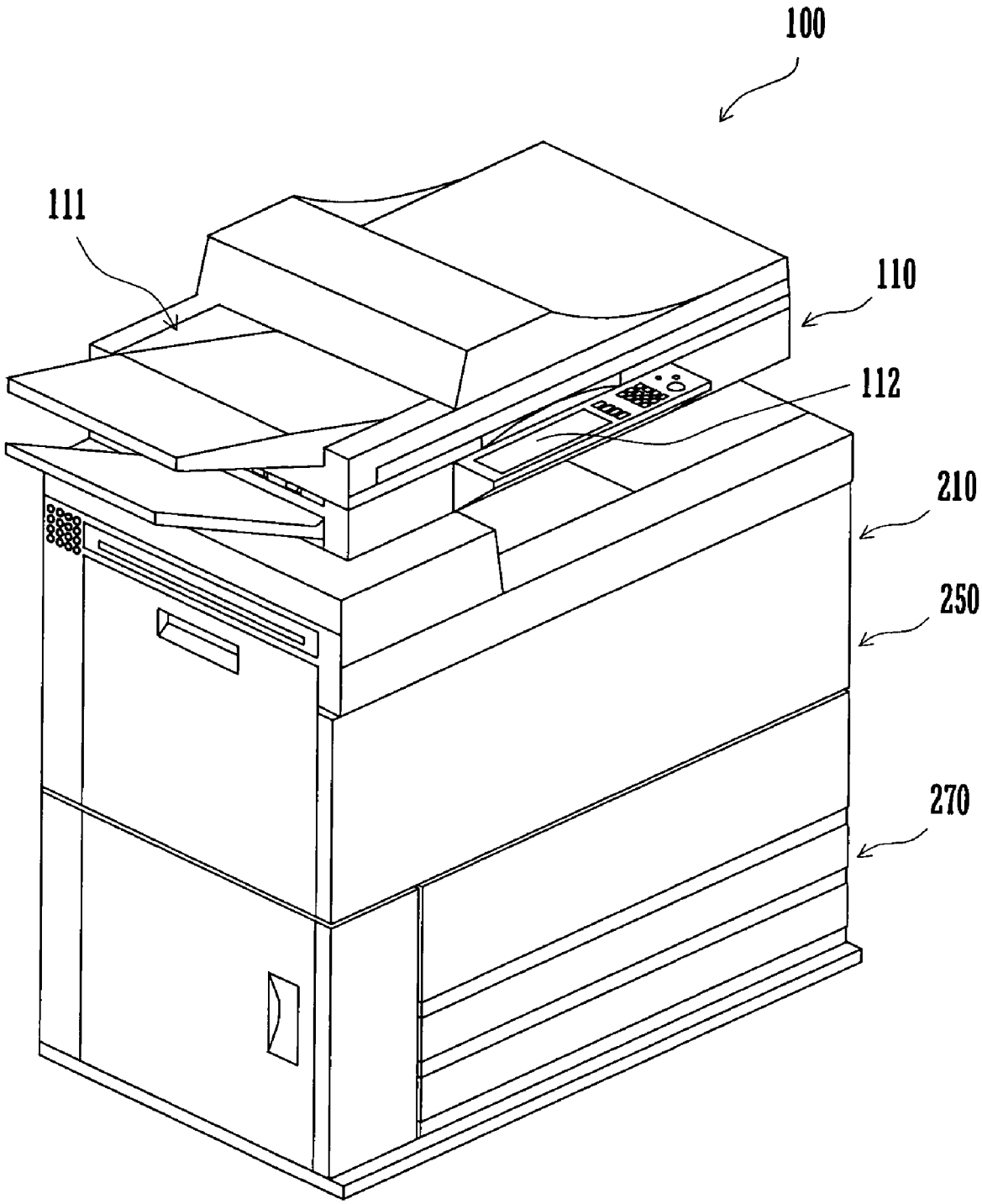
FIG. 9 is a perspective view showing the image forming apparatus.

FIG. 8 schematically illustrates the construction of a digital multifunction machine 100 as another embodiment of image forming apparatus according to the present invention. In the digital multifunction machine 100, a document image read at a reading section (document reading apparatus) 110 is transmitted as image data to a non-illustrated image data input section. After having undergone predetermined image processing, the image data is temporarily stored in memory provided in an image processing section. The image data in the memory is read out in response to an output instruction and then transferred to a laser writing unit 227 as an optical writing device provided in an image forming section 210. As shown in FIG. 9, an ADF 111 is mounted on the reading section (document reading apparatus) 110, and a control panel 112 is provided on the manipulation side.

The laser writing unit 227 generally comprises a semiconductor laser light source for emitting laser light in accordance with image data read out of the memory or image data transferred from an external device, a polygon mirror for deflecting laser light by rotation at a constant angular velocity, and an f-? lens for performing correction so that the laser light deflected at a constant angular velocity is deflected at a constant angular velocity on a photosensitive drum 222. Although the laser writing unit is used as the writing device in this embodiment, use may be made of an optical writing head unit of a solid-state scanning type which comprises an array of light emitting elements such as LEDs or EL devices.

The image forming section 210 further includes, around the photosensitive drum 222, an electrostatic charger 223 for charging the photosensitive drum 222 to a predetermined potential, a developer 224 for supplying toner onto an electrostatic latent image formed on the photosensitive drum 222 to make the image tangible, a transfer device (e.g. transfer charger) 225 for transferring the toner image formed on the surface of the photosensitive drum 222 to a sheet, a cleaner 226 for recovering excess toner, and a static eliminator (e.g. charger for static elimination) 229. The sheet onto which the image is transferred at the image forming section 210 is then fed to a fixing unit 217, where the image is fixed to the sheet.

On the ejection side of the image forming section 210 are provided, besides the fixing unit 217, a switchback path 221 for inverting the sheet front side back for formation of an image on the reverse surface of the sheet, and a post-processing device 260 which is provided with an up-and-down tray 261 and performs stapling or other processing for sheets bearing respective images formed thereon. The sheet on which a toner image has been fixed at the fixing unit 217 is guided to the post-processing device 260 by a sheet ejecting roller 219 optionally through the switchback path 221, subjected to appropriate post-processing, and then ejected.

Below the image forming section 210 is provided a sheet feeder section which comprises a manual feed tray 254, a reversing unit 255 and a sheet tray 251 which are provided on or in the apparatus body, and sheet trays 252 and 253 provided in a multi-tier sheet feeder section 270. The sheet feeder section further includes a transport section 250 for transporting a sheet fed from any one of the trays 251, 252, 253 and 254 to a transfer position in the image forming section 210 where the transfer device is located.

The reversing unit 255, which communicates with the switchback path 221 for inverting each sheet, is used in forming images on both sides of the sheet. The reversing unit 255 is so configured such that it can be replaced with an ordinary sheet cassette. Therefore, an arrangement is possible where an ordinary sheet cassette is disposed instead of the reversing unit 255.

The digital multifunction machine 100 thus constructed may be provided with the sheet feeder device 51 shown in FIGS. 2 to 7 in the transport unit 250, i.e. 250*a*, 250*b*, 250*c* and 250*d*.

The image reading apparatus according to the present invention is not limited to the construction shown in FIG. 1. The present invention is applicable to any image reading apparatus irrespective of the construction and type thereof as far as the image reading apparatus can include a sheet feeder device comprising, at least, a sheet accommodating section for accommodating a stack of sheets; a sheet pick-up section operative to feed each of the sheets toward a sheet feed path when abutting against the stack; and a sheet separating section having a feed roller and a reverse roller which are located downstream of the sheet pick-up section and abut against each other.

Moreover, the image forming apparatus according to the present invention is not limited to the construction shown in FIGS. 8 and 9. The present invention is applicable to any image forming apparatus irrespective of the construction and type thereof as far as the image forming apparatus includes a sheet feeder device comprising, at least, a sheet accommodating section for accommodating a stack of sheets; a sheet pick-up section operative to feed each of the sheets toward a sheet feed path when abutting against the stack; and a sheet separating section having a feed roller and a reverse roller which are located downstream of the sheet pick-up section and abut against each other.

While only certain presently preferred embodiments of the present invention have been described in detail, as will be apparent for those skilled in the art, certain changes and modifications may be made in embodiments without departing from the spirit and scope of the present invention as defined by the following claims.

What is claimed is:

1. A sheet feeder device, comprising:

a sheet accommodating section for accommodating a stack of sheets;

a sheet pick-up section operative to feed each of the sheets toward a sheet feed path when abutting against the stack; and a sheet separating section having a feed roller and a reverse roller which are located downstream of the sheet pick-up section and biased to abut against each other, wherein:

the reverse roller is supported on a rotation support shaft in a manner to allow the reverse roller to be fitted around and removed from the rotation support shaft in an axial direction of the rotation support shaft;

the rotation support shaft has opposite ends, which are rotatably supported by a device body via a respective first support and a respective second support; and the first support is selectively switchable between a first position in which the reverse roller is not removable from the rotation support shaft, and a second position in which the first support allows the reverse roller to move away from the feed roller and allows a first end of the rotation support shaft to be disengaged from the first support, the first support, located at one end of the rotation support shaft, having a first support member pivotally supported by the device body, and a second support member that is removable from the first support member and includes a shaft hole through which the rotation support shaft extends, the first support member being attached to a resilient member providing rotational tension on the first support member about its pivoting axis, the second support member being removable from the first support member while the resilient member maintains the tension on the first support member.

2. The sheet feeder device according to claim 1, wherein the second support supports the rotation support shaft via a universal joint for swinging movement.

3. The sheet feeder device according to claim 1, wherein the rotation support shaft being detachable from the second support member when the second support member is detached from the first support member.

4. The sheet feeder device in according to claim 3, wherein the resilient member bridging the first support member and the device body for biasing the reverse roller into abutment against the feed roller at a predetermined pressure.

5. The sheet feeder device according to claim 4, wherein the first support member includes a release lever portion for separating the reverse roller away from the feed roller by disengaging the first end of the rotation support shaft from the first support, the release lever portion and an openable external cover provided on the device body being cooperatively connected to each other via a coupling lever, the reverse roller being removed from the disengaged first end of the rotation support shaft.

6. An image reading apparatus including a sheet feeder device for feeding a sheet on which an image is recorded, and an optical scanning system for reading the image on the sheet, the sheet feeder device, comprising:

a sheet accommodating section for accommodating a stack of sheets;

a sheet pick-up section operative to feed each of the sheets toward a sheet feed path when abutting against the stack; and a sheet separating section having a feed roller and a reverse roller which are located downstream of the sheet pick-up section and biased to abut against each other, wherein:

the reverse roller is supported on a rotation support shaft in a manner to allow the reverse roller to be fitted around and removed from the rotation support shaft in an axial direction of the rotation support shaft;

the rotation support shaft has opposite ends, which are rotatably supported by a device body via a respective first support and a respective second support; and the first support is selectively switchable between a first position in which the reverse roller is not removable from the rotation support shaft, and a second position in which the first support allows the reverse roller to move away from the feed roller and allows a first end of the rotation support shaft to be disengaged from the first support, the first support, located at one end of the rotation support shaft, having a first support member pivotally supported by the device body, and a second support member that is removable from the first support member and includes a shaft hole through which the rotation support shaft extends, the first support member being attached to a resilient member providing rotational tension on the first support member about its pivoting axis, the second support member being removable from the first support member while the resilient member maintains the tension on the first support member.

7. The image reading apparatus according to claim 6, wherein the second support supports the rotation support shaft via a universal joint for swinging movement.

8. The image reading apparatus according to claim 6, wherein the rotation support shaft being detachable from the second support member when the second support member is detached from the first support member.

9. The image reading apparatus according to claim 8, wherein the resilient member bridging the first support member and the device body for biasing the reverse roller into abutment against the feed roller at a predetermined pressure.

10. The image reading apparatus according to claim 9, wherein the first support member includes a release lever portion for separating the reverse roller away from the feed roller, the release lever portion and an openable external cover provided on the device body being cooperatively connected to each other via a coupling lever.

11. An image forming apparatus including a sheet feeder device for feeding a sheet on which an image is recorded, an optical scanning system for reading the image on the sheet, and an image forming section for forming an image on an image carrier based on image data obtained from the image on the sheet read by the optical scanning system, the sheet feeder device, comprising:

a sheet accommodating section for accommodating a stack of sheets;

a sheet pick-up section operative to feed each of the sheets toward a sheet feed path when abutting against the stack; and a sheet separating section having a feed roller and a reverse roller which are located downstream of the sheet pick-up section and biased to abut against each other, wherein:

the reverse roller is supported on a rotation support shaft in a manner to allow the reverse roller to be fitted around and removed from the rotation support shaft in an axial direction of the rotation support shaft;

the rotation support shaft has opposite ends, which are rotatably supported by a device body via a respective first support and a respective second support; and the first support is selectively switchable between a first position in which the reverse roller is not movable from the rotation support shaft, and a second position in which the first support allows the reverse roller to move away from the feed roller and allows a first end of the rotation support shaft to be disengaged from the first support, the first support, located at one end of the rotation support shaft, having a first support member pivotally supported by the device body, and a second support member that is removable from the first support member and includes a shaft hole through which the rotation support shaft extends, the first support member being attached to a resilient member providing rotational tension on the first support member about its pivoting axis, the second support member being removable from the first support member while the resilient member maintains the tension on the first support member.

12. The image forming apparatus according to claim 11, wherein the second support supports the rotation support shaft via a universal joint for swinging movement.

13. The image forming apparatus according to claim 11, wherein the rotation support shaft being detachable from the second support member when the second support member is detached from the first support member.

14. The image forming apparatus according to claim 13, wherein the resilient member bridging the first support member and the device body for biasing the reverse roller into abutment against the feed roller at a predetermined pressure.

15. The image forming apparatus according to claim 14, wherein the first support member includes a release lever portion for separating the reverse roller away from the feed roller, the release lever portion and an openable external cover provided on the device body being cooperatively connected to each other via a coupling lever.

16. The sheet feeder device according to claim 1, wherein the first support directly supports the first end of the rotation support shaft and the second support directly supports a second end of the support shaft opposite to the first end.

17. The image reading apparatus according to claim 6, wherein the first support directly supports the first end of the rotation support shaft and the second support directly supports a second end of the support shaft opposite to the first end.

18. The image forming apparatus according to claim 11, wherein the first support directly supports the first end of the rotation support shaft and the second support directly supports a second end of the support shaft opposite to the first end.

* * * * *